US005096452A

United States Patent [19]

Wagener

[11] Patent Number: 5,096,452

[45] Date of Patent: Mar. 17, 1992

[54] WHEEL MOUNT FOR A MODEL AIRPLANE

[75] Inventor: Claus Wagener, Dietenhofen, Fed. Rep. of Germany

[73] Assignee: Fritz Wagener GmbH

[21] Appl. No.: 641,936

[22] Filed: Jan. 16, 1991

[30] Foreign Application Priority Data

Jan. 16, 1990 [DE] Fed. Rep. of Germany ..... 4001032

[51] Int. Cl.[5] ..... A63H 27/00; A63H 17/26

[52] U.S. Cl. ..... 446/34; 446/55; 446/230; 446/469

[58] Field of Search ..... 446/34, 55, 56, 57, 446/58, 61, 63, 68, 93, 95, 96, 230, 431, 465, 466, 469, 470, 471

[56] References Cited

U.S. PATENT DOCUMENTS

| | | | |
|---|---|---|---|
| 1,705,209 | 3/1929 | Ryan | 446/230 X |
| 1,708,335 | 4/1929 | Sprague | 446/230 |
| 2,403,129 | 7/1946 | Shaeffer | 446/230 |
| 2,917,865 | 12/1959 | Bergstrand | 446/34 |
| 3,005,285 | 10/1961 | Girz | 446/469 X |
| 4,061,339 | 12/1977 | Coster | 446/471 X |
| 4,194,317 | 3/1980 | Kidd | 446/68 |

FOREIGN PATENT DOCUMENTS

| | | | |
|---|---|---|---|
| 970891 | 11/1958 | Fed. Rep. of Germany | 446/55 |
| 858347 | 1/1961 | United Kingdom | 446/230 |

*Primary Examiner*—Mickey Yu
*Assistant Examiner*—D. Neal Muir
*Attorney, Agent, or Firm*—Toren, McGeady & Associates

[57] ABSTRACT

In a model airplane having a landing gear 5 provided on a fuselage 1 or wing made as a zinc-alloy die-casting where a bearing member 19 is suspended from a strut 18, it is desirable that the manufacture of an accurately modelled landing gear be simplified. This is achieved in that a landing gear 8 formed with two clasp member arms 10 made of elastically bendable plastic forms the bearing member 19 and at least partially the strut 18 with a tenon 11 being inserted and glued into a cast cavity 12 in the fuselage 1/wing wherein the clasp member 8 bears against the zinc-alloy die-casting with a thickening shoulder 17. The clasp member being a plastic moulding permits a finely engraved realistic appearance of the strut and bearing member while simplifying assembly of the wheel pair and reducing the scrapping rate.

6 Claims, 1 Drawing Sheet

WHEEL MOUNT FOR A MODEL AIRPLANE

DESCRIPTION

Figure 1:
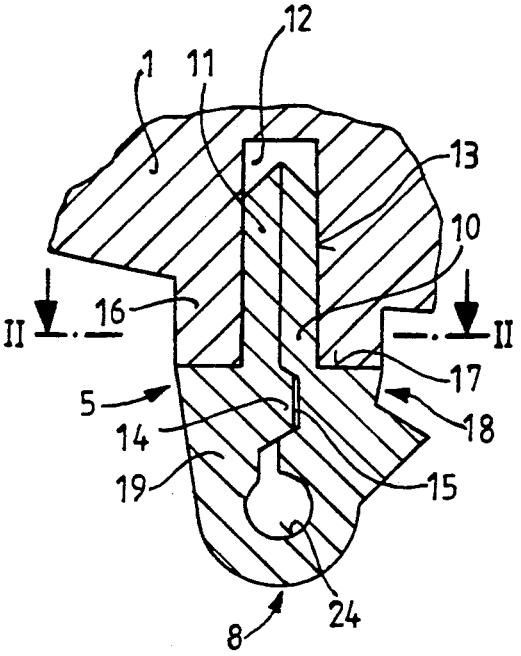

This invention relates to a model airplane having at the underside of a die-cast zinc-alloy fuselage or wing a landing gear wherein a strut attached to the fuselage/wing carries a bearing member which receives an axle of a pair of wheels.

In a prior-art model airplane of this type, the strut and bearing member are formed integrally with the fuselage/wing as a zinc-alloy die-casting and the bearing member is initially a U-structure whose legs are bent around the axle of the wheel pair and which may subsequently be secured by beading. Producing the bearing member and strut as a zinc-alloy die-casting and locating the Wheel pair by die-cast zinc-alloy legs poses problems in moulding and assembly and do not afford a sufficiently finely engraved realistic appearance. The U-structure appears crude or coarse and the legs tend to break off easily on removal from the mould and during handling.

Accordingly, it is an object of the invention to provide a model airplane of the type initially referred whereby the manufacture of an accurately modelled landing gear is facilitated. In achieving this object, the model airplane according to the invention is characterized in that a clasp member made of elastically bendable plastic and having two arms juxtaposed forms the bearing member and at least partly the landing gear strut and terminates in a tenon which is inserted and glued into a cavity cast in the fuselage/wing, said clasp member bearing with a thickening shoulder against the zinc-alloy die-casting and the seat of the landing gear in the fuselage/wing being such as to prevent rotation irrespective of the glueing.

The moulded plastic clasp member permits finely engraved realistic shaping of the landing gear strut and bearing member. Moulding the cavity in the zinc-alloy die-casting is much simpler than moulding a projection forming the strut and bearing member as a zinc-alloy die-casting. Assembly of the wheel pair is simplified and involves a reduced rate of scrapping. What is essential is less the suspension of the wheel pair by means of the clasp member from the fuselage/wing than the method of locating the plastic clasp member on the die-cast zinc-alloy fuselage/wing and the matching configuration of the clasp member.

It is especially desirable and advantageous to have one of the two juxtaposed clasp arms registering with a projection in a recess of the other arm to provide locking action. This ensures accurate alignment of the two arms relative to each other in a manner that is little visible from the outside. If the landing gear is subject to a heavy load, bending will occur and the tongue-in-groove configuration will transmit the load to the two clasp arms despite the bending.

It is further desirable and advantageous to have the tenon and the cavity made with a square cross-section. This renders the seat of the landing gear in the fuselage/wing secure against rotation without relying of the glueing. During assembly accurate positioning of the landing gear relative to the fuselage/wing is facilitated.

It is further desirable and advantageous to have a projection strut made integrally with the zinc-alloy die-casting of the fuselage/wing to house the cavity receiving the tenon. Due to the die-cast zinc-alloy strut part, the moulding pin forming the cavity will be less stressed in bending and compression as a result of shrinkage on cooling of the zinc-alloy die-casting. This configuration would as a rule be used for a nose wheel of a landing gear. However, it also lends itself well for the landing gear under the wings because the depth of the cavity that is possible in the wing itself is limited.

It is further specially desirable and advantageous to have the bearing member of the clasp member for two wheel pairs provided with two bearing holes in parallel with each other to be arranged on either side of the extended centre line of the strut. In other words, the clasp member enables two pair of wheels to be attached to one strut which is not possible with the prior art configuration of strut and bearing member made as a zinc-alloy die-casting. This structure having two bearing bores would as a rule be used for the main landing gear.

Die-casting zinc alloy is the most advantageous and commonly used die-casting metal and consists of a zinc-alloy aluminium alloy. Other aluminium alloys may be used for the purpose of the invention including pure aluminium. The plastic material of the landing gear would as a rule be coloured by means of a silver colorant so as to match the colour of the landing gear to that of the die-casting zinc alloy of the fuselage and/or wing. The combination very good rolling properties of the model airplane.

Figure 3:
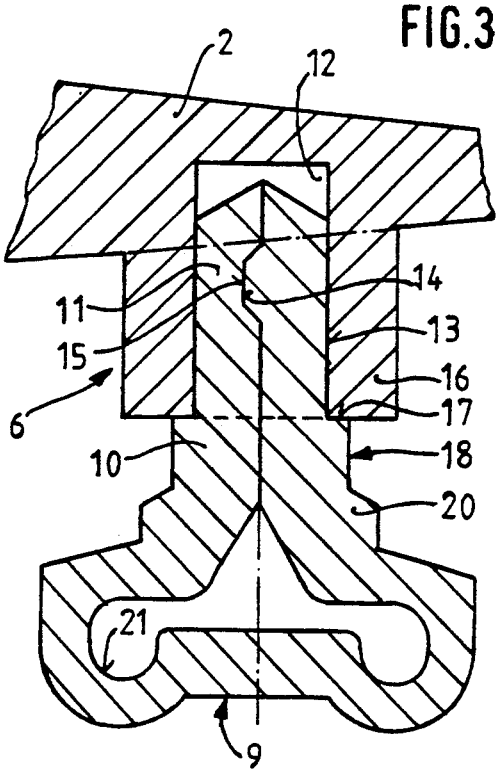
Figure 2:
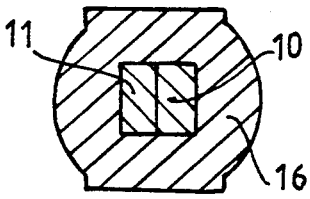
Figure 4:
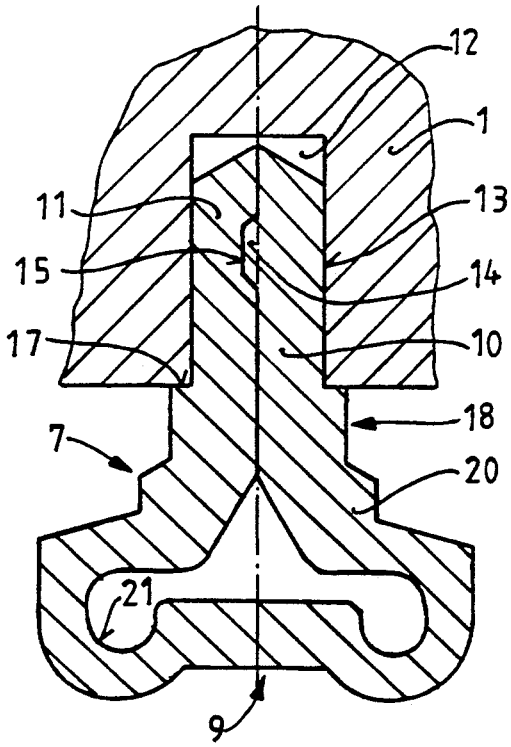
Figure 5:
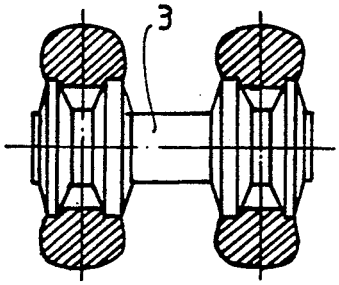

The preferred embodiments of the invention are illustrated in the attached drawing in which FIG. 1 is a vertical section through a first part of the model airplane, FIG. 2 is a section along the line II—II in FIG. 1, FIG. 3 is a vertical section through a second part of the model airplane in FIG. 1, FIG. 4 is a vertical section through a third part of the model airplane in FIG. 1, and FIG. 5 is a vertical section through a fourth part of the model airplane in FIG. 1.

Referring to the drawing, the model airplane has a fuselage 1 and two wings 2 which are of integral construction consisting of die-casting zinc alloy and which are only fragmentarily shown. As shown in FIG. 1, a landing gear 5 configured as a nose wheel is attached under the front end of the fuselage. As shown in FIG. 3, a landing gear 6 configured as a main landing gear is attached to the wing 2. As shown in FIG. 4, a landing gear configured as a main landing gear is attached to the fuselage 1. Each landing gear includes a pair of wheels 4 interconnected by a metal axle 3 as shown in FIG. 5. FIG. 5 is drawn on an enlarged scale compared to FIGS. 1–4.

The landing gears 5, 6, 7 each comprise a clasp member 8, 9 whose juxtaposed arms 10 are of a square cross-section as shown in FIG. 2 and which are inserted with a terminal tenon 11 into a cavity 12 of the fuselage 1 or, respectively, wing 2. Glue 13 is provided between the walls of the cavity 12 and the tenon 11. The one clasp member arm 10 engages a recess 15 with a matching projection 14, these locking devices being located either inside the cavity 12 or outside the cavity. In the case of the nose wheel 5 shown in FIG. 1 and the wing-suspended landing gear 6 shown in FIG. 3, the cavity 12 is partly formed by a projecting strut part 16 which is integral with the zinc-alloy die-casting of the fuselage 1 or, respectively, the wing 2. As shown in FIG. 4, the cavity 12 may be located entirely in the fuselage 1.

The juxtaposed clasp member arms 10 are formed all round with a radially thickening shoulder 17 which bears upon the zinc-alloy die-casting, i.e. the strut part 16 or the fuselage 1. Continuing downwards, the clasp member arms form a strut extension 18 down to a plastic bearing member 19, 20. While the bearing member 19 of the nose wheel 5 shown in FIG. 1 has only one bearing bore 21 under the tenon 11, the bearing member 20 used for the two main landing gears 6, 7 each has two parallel bearing bores 21 each to receive a metal axle, the two bearing bores being arranged on either side of the juxtaposed clasp member arms 10 or, respectively, their continued centre line. The juxtaposed clasp member arms 10 terminate in a pointed end to facilitate insertion in the cavity 12.

I claim:

1. Model airplane, having a landing gear provided on an underside of a fuselage or wing consisting of a zinc-alloy die-casting, and having a strut attached to said fuselage/wing suspending a bearing member to receive an axle of a pair of wheels, characterized in that a clasp member made of elastically bendable plastic formed with two juxtaposed arms (10) forms the bearing member (19, 20) and, at least partly, the strut (18), said clasp member terminating in a tenon (11) which is inserted and glued into a cast cavity (12) in the fuselage (1)/wing (2), and said clasp member bearing against the zinc-alloy die-casting with a thickening shoulder (17) and the landing gear (8) in the fuselage (1)/wing (2) having a seat that is shaped to resist rotation independent of the gluing.

2. Model airplane as in claim 1, wherein one of the two juxtaposed arms (10) engages a recess (15) in the other arm with a projection (14) for locking action.

3. Model airplane as in claim 1 or 2, wherein the tenon(11) and the cavity (12) are of square cross-section.

4. Model airplane as in claim 1, wherein characterized a strut member (16) is formed integrally with the zinc-alloy die-casting of the fuselage (1)/wing (2) and houses the cavity (12) receiving the tenon (11).

5. Model airplane as in claim 1, wherein the bearing member (20) of the clasp member is provided with two parallel bearing bores (21) for two wheel pairs and arranged on either side of the continuation of the centre line of the strut (18).

6. Model airplane as in claim 1, wherein the plastic material of the clasp member is coloured with a silver colorant to match the colour of the zinc-alloy die-casting.

* * * * *

UNITED STATES PATENT AND TRADEMARK OFFICE

CERTIFICATE OF CORRECTION

PATENT NO. : 5,096,452

DATED : 17 March 1992

INVENTOR(S) : Claus Wagener

It is certified that error appears in the above-identified patent and that said Letters Patent is hereby corrected as shown below:

ON THE TITLE PAGE

Item [73], please add -- Fritz Wagener, GmbH
Dietenhofen, Federal Republic
of Germany Signed and Sealed this Twentieth Day of July, 1993

*Attest:*

Michael K. Kirk

MICHAEL K. KIRK

*Attesting Officer*

*Acting Commissioner of Patents and Trademarks*